US006170086B1

(12) United States Patent
Lee

(10) Patent No.: US 6,170,086 B1
(45) Date of Patent: Jan. 9, 2001

(54) CAP HAVING FULL REAR ADJUSTMENT BAND

(76) Inventor: Razgo Lee, 1810 S. Vineyard Ave., Ontario, CA (US) 91761

( * ) Notice: Under 35 U.S.C. 154(b), the term of this patent shall be extended for 0 days.

(21) Appl. No.: 09/374,571

(22) Filed: Aug. 13, 1999

(51) Int. Cl.[7] ..... A42B 1/00
(52) U.S. Cl. ..... 2/195.3; 2/183
(58) Field of Search ..... 2/195.3, 195.2, 2/183, 175.1, 195.1, 209.12

(56) References Cited

U.S. PATENT DOCUMENTS

| | | | | |
|---|---|---|---|---|
| 5,402,538 | | 4/1995 | Conrad . | |
| 5,615,415 | * | 4/1997 | Beckerman | 2/195.3 |
| 5,715,540 | | 2/1998 | Cho . | |
| 5,966,742 | * | 10/1999 | Cunliffe | 2/195.3 |

* cited by examiner

*Primary Examiner*—Bibhu Mohanty

(74) *Attorney, Agent, or Firm*—Chan Law Group, LC; Marcia Devon

(57) ABSTRACT

An adjustable cap apparatus comprising a crown portion having a front end and a rear end, an opening disposed on the rear end of the crown portion, a visor attached to the front end of the crown portion, and stretchable material completely covering the opening such that surface continuity with the crown portion is maintained. The multi-axial stretchability and resiliency of the material covering the opening allows for both halves of the crown portion to either be drawn together or spread apart to fit the wearer, thereby providing a degree of adjustability to the cap and comfort to the wearer. The stretchable material disposed within the opening has a greater stretchability than the material of the crown portion, even when the crown portion is composed predominantly of a stretchable material, thereby serving the purpose of increasing the degree of adjustability in caps already incorporating stretchable material in the crown portion. The complete closure of the opening not only eliminates the long plaguing problem of the wearer's hair protruding through the opening, but also eliminates the problem of material gathering or bunching up above the opening, thereby resulting in a more desirable appearance and greater comfort for the wearer.

19 Claims, 3 Drawing Sheets

CAP HAVING FULL REAR ADJUSTMENT BAND

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to headgear, and more particularly, to a cap having a full fitting adjustment band.

2. Description of the Background Art

To accommodate the numerous head sizes of wearers, caps are typically individually sized or are otherwise adjustable to suit a particular individual's sizing needs. Individually sized caps are constructed based on universally adopted size standards, which are based on head circumference measurement. Although individually sized caps generally provide the wearer a comfortable fit and a tailor-made appearance, they are quite expensive due to the high cost of manufacture and of logistically maintaining a large inventory of a variety of different sizes.

To avoid problems associated with individually sized caps, adjustment mechanisms or devices have been incorporated into the cap. Known adjustment mechanisms or devices include an elastic band circumferentially disposed around the base of the crown portion, or an elastic band around the rear of the crown portion beneath the fabric of the crown portion. Although the elastic band provides for a secure fit for the wearer around the base of the crown portion, sections of the crown portion above the base tend to gather and bunch up, especially when the cap is worn on a relative small head. The lack of an opening or cutout on the rear end of such caps causes an even more pronounced deformation of the crown portion.

To alleviate the problem of the crown portion gathering and bunching up, caps incorporate a cutout or opening at the rear end of the crown portion. The cutout or opening thereby allows for drawing both the left and right halves of the crown portion together, as well as disposes of some fabric on the crown portion that may be subject to gather or bunch up above the opening, especially when the cap is worn on a small head. An adjustment strap is suspended around the rear of the crown portion and across the cutout or opening. The adjustment strap may incorporate a plurality of studs protruding from one strap and a plurality of holes in the other strap which are sized for positive engagement with the studs for size adjustment. The adjustment strap may otherwise incorporate hook and loop or hook and pile fasteners, typically known as VELCRO™, which are disposed on the strap surfaces for size adjustment. Numerous other types of mechanisms have been implemented for size adjustment. Inherent in the nature of the cutout or opening, however, it allows for hair to protrude through the cutout or opening in space between its border and the upper edge of the adjustment strap. This results in an unsightly appearance and uncomfortable feel for the wearer. The crown portion also has a tendency to gather or bunch up adjacent the apex of the cutout or opening, especially when the adjustment straps are drawn closely together. Moreover, since the crown portion of adjustable caps must typically be sized to fit heads in the larger sizes, this results in an undesirable appearance for wearers in the smaller size ranges.

Accordingly, there is a need for a cap that provides a fitted appearance and feel without the problems commonly associated with either sized or adjustable caps. The present invention satisfies this need, as well as others, and generally overcomes the problems found in the background art.

BRIEF SUMMARY OF THE INVENTION

The present invention generally pertains to an adjustable cap capable of accommodating multiple head sizes, without the problems of hair protruding from the rear end thereof or of fabric of the crown portion gathering or bunching up. By way of example and not of limitation, the invention generally comprises a crown portion having a front end and a rear end, an opening disposed on the rear end of the crown portion, a visor attached to the front end of the crown portion, and stretchable material completely covering the opening on the rear end of the crown portion, such that surface continuity with the crown portion is maintained.

The cutout or opening, is preferably but not necessarily semicircular in shape, and partially separates the left side and the right side of the crown portion. The multi-axial stretchability and resiliency of the material covering the opening allows for both halves of the crown portion to either be drawn together or spread apart to fit the wearer, thereby providing a degree of adjustability to the cap and comfort to the wearer.

The stretchable material disposed within the opening has a greater stretchability than the material of the crown portion, even when the crown portion is composed predominantly of a stretchable material. Therefore, the combination of the opening and the and the stretchable material disposed within the opening, serves the purpose of increasing the degree of adjustability in caps already incorporating stretchable material in the crown portion. The complete closure of the opening not only increases comfort for the wearer, but also, eliminates the problem of hair protruding through the opening.

An object of the invention is to provide a cap that is adjustable.

Another object of the invention is to provide a cap having a rear opening that is completely covered by a stretchable adjustment band.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus generally shown in FIG. 1 through FIG. 6. It will be appreciated that the apparatus may vary as to configuration and as to details of the parts without departing from the basic concepts as disclosed herein.

Figure 1:
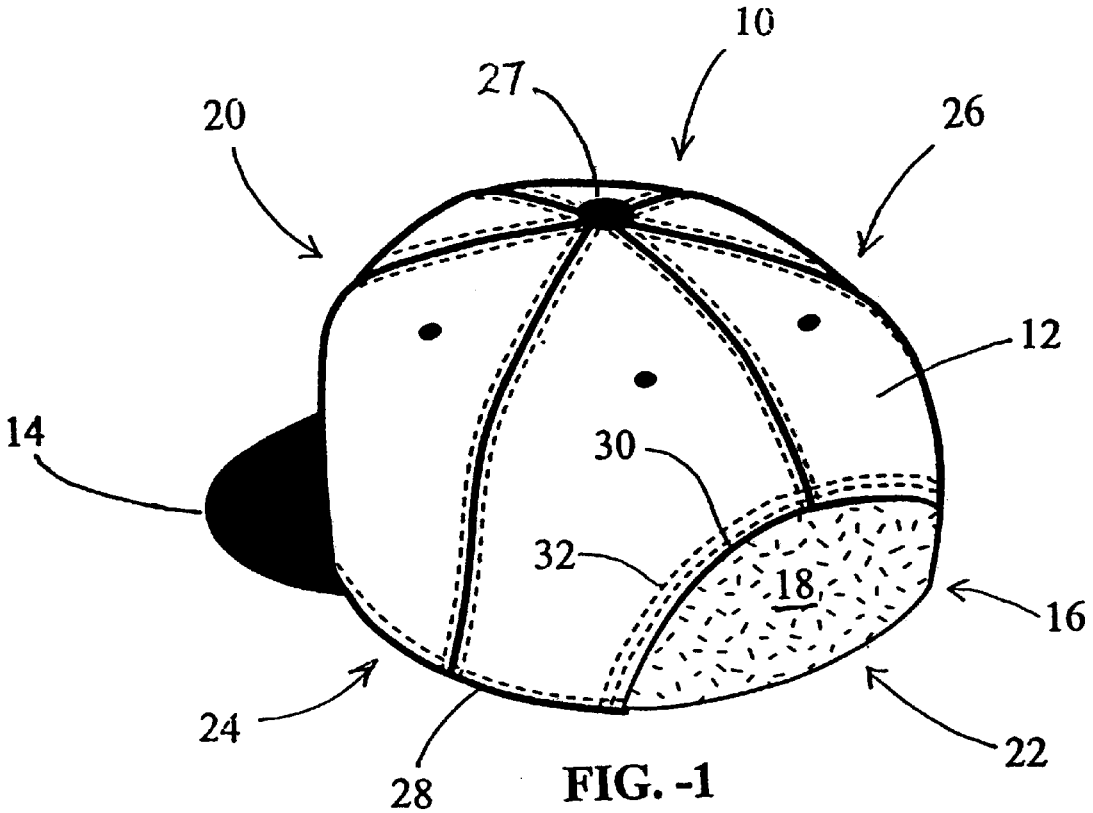
FIG. 1 is a perspective view of a preferred embodiment of an adjustable cap apparatus in accordance with the present invention.
Figure 2:
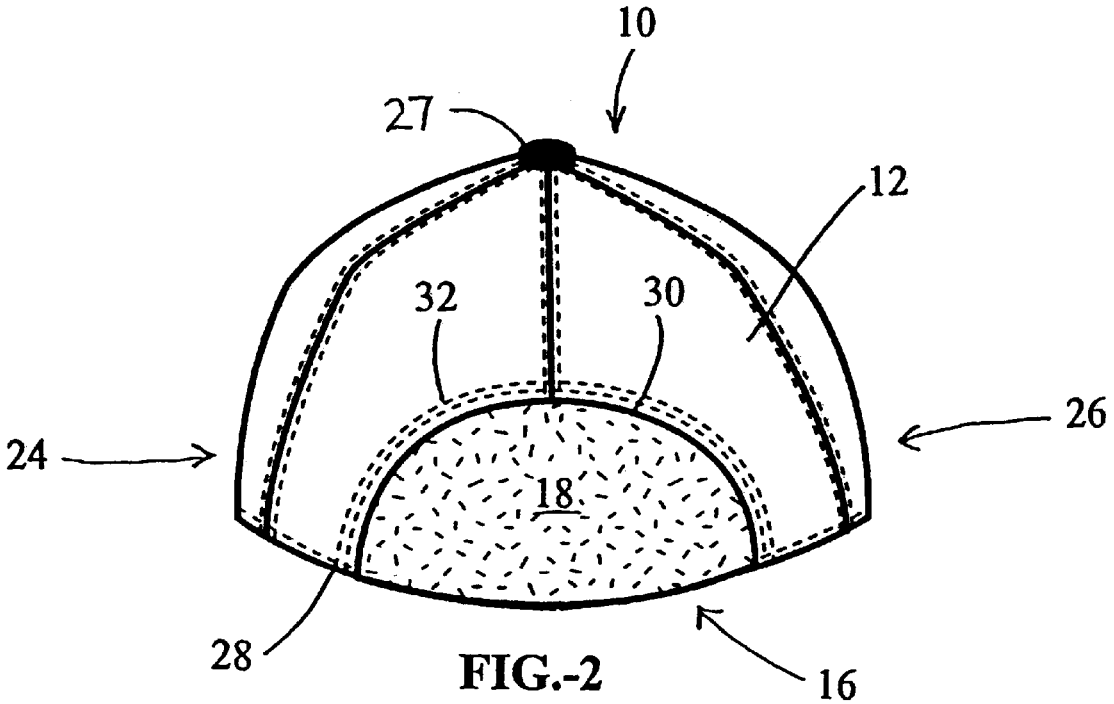
FIG. 2 is a rear elevational view of the cap apparatus shown in FIG. 1.
Figure 3:
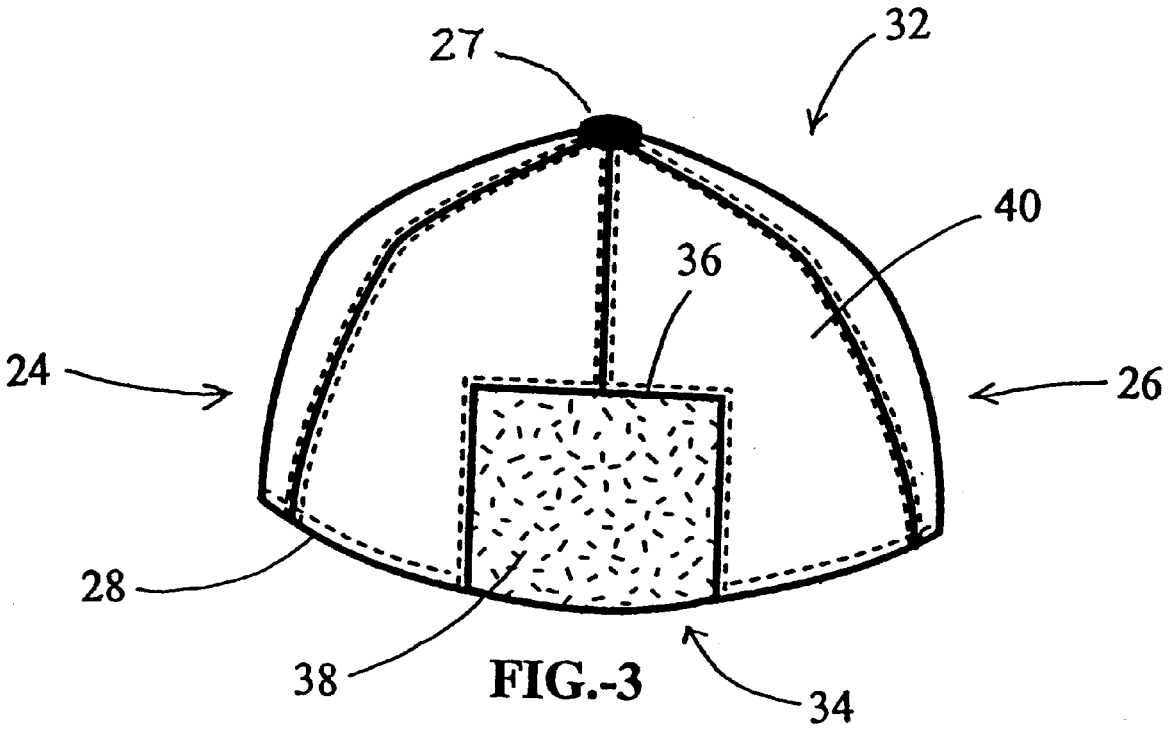
FIG. 3 is a rear elevational view of a second embodiment of an adjustable cap apparatus in accordance with the present invention.

Referring first to FIG. 1 and FIG. 2, a preferred embodiment of an adjustable cap apparatus 10 in accordance with the present invention is generally shown. Apparatus 10 comprises a crown portion 12, a visor 14, an opening 16, and an adjustment band 18.

Crown portion 12 includes a front end 20, a rear end 22, a left side 24, a right side 26, a vertex 27, and a bottom edge 28. Crown portion 12 is fabricated from a first material that is flexible, such as, but not limited to, cloth, plastic and the like. First material may also be stretchable, such as but not limited to SPANDEX™, LYCRA™, and the like. Crown portion 12 may also be fabricated from a third material, as well as a first material. In such designs, the third material typically occupies front end 20 of crown portion 12, and an example of which being, a first material of plastic and a third material of foam fabric.

Opening 16 is preferably semicircular in shape and is disposed in rear end 22 of crown portion 12, and partially separates left side 24 and right side 26 of crown portion 12. The border 30 that outlines opening 16 extends toward bottom edge 28 of crown portion 12, thereby creating a rearwardly disposed void between left side 24 and right side 26 of crown portion 12. It can be seen that opening 16 extends upwardly from bottom edge 28 of crown portion 12 part way toward vertex 27 of crown portion 12.

Adjustment band 18 generally comprises a second material that possesses greater stretchability than the first material that forms crown portion 12. The second material is preferably stretchable along multiple axes and includes an elastic band. Adjustment band 18 is preferably sewn to crown portion 12, wherein the stitches 32 that join adjustment band 18 to crown portion 12 extend continuously and adjacent border 30. To be more aesthetically appealing, the upper edge (not shown) of adjustment band 18 is disposed beneath crown portion 12. The continuity of stitches 32 and its proximity to border 30 serves to generally maintain surface continuity between crown portion 12 and adjustment band 18. Additionally, the continuity of stitches 32 and its proximity to border 30 allow for a more uniform expansion of rear end 22, left side 24, and right side 26 crown portion 12, thereby resulting in a more aesthetically pleasing appearance and greater comfort to the wearer.

Figure 4:
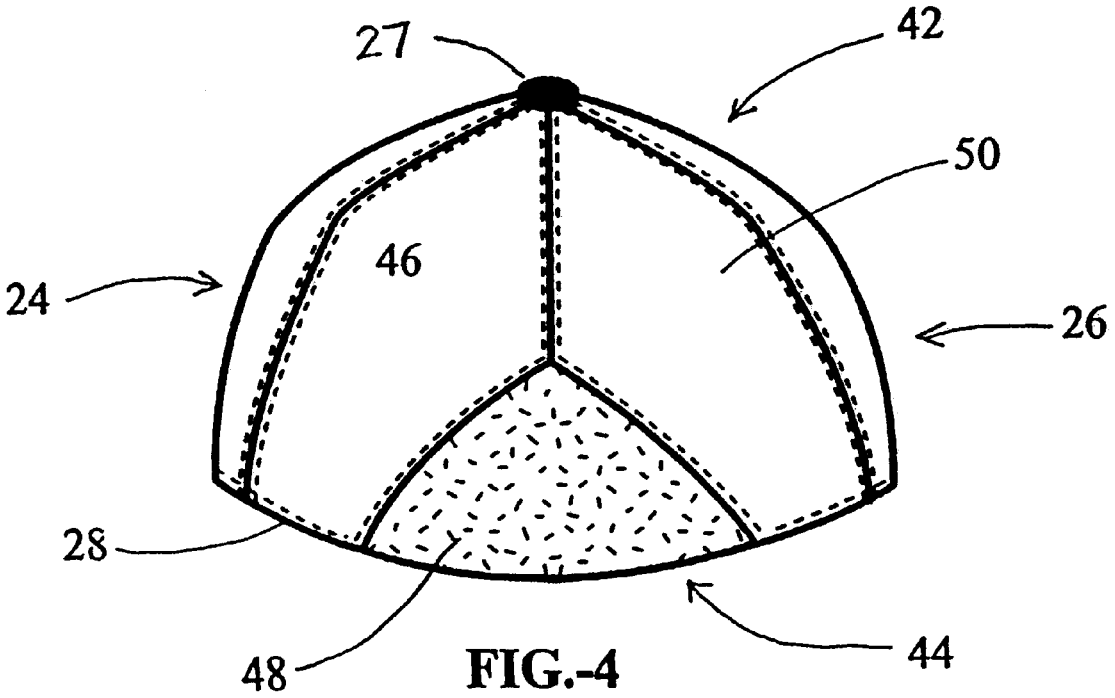
FIG. 4 is a rear elevational view of a third embodiment of an adjustable cap apparatus in accordance with the present invention.
Figure 5:
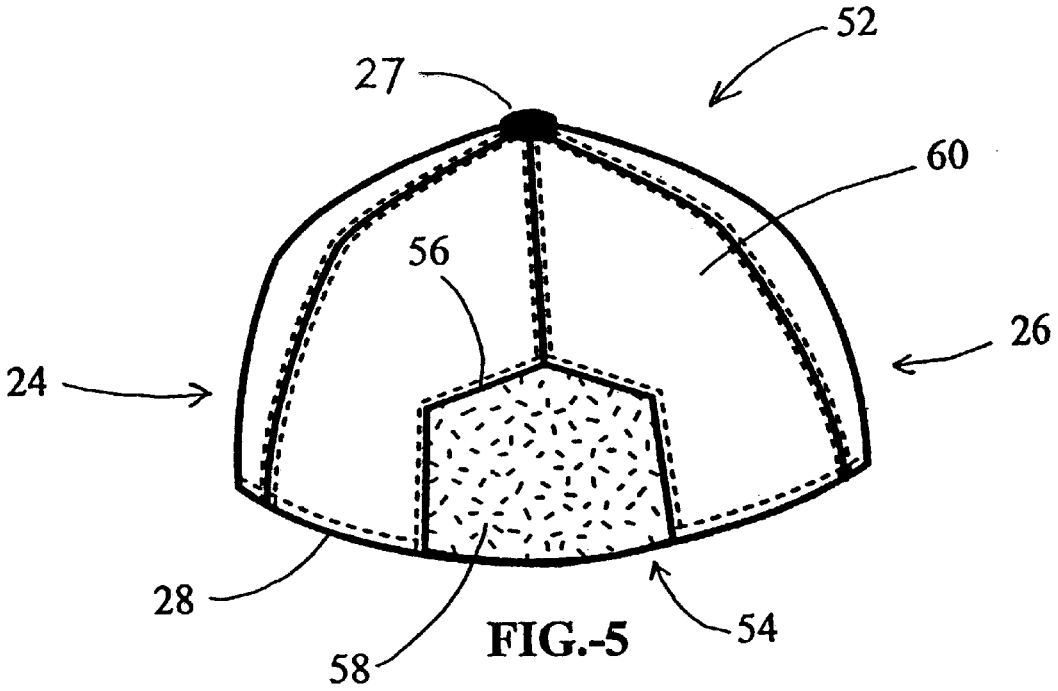
FIG. 5 is a rear elevational view of a fourth embodiment of an adjustable cap apparatus in accordance with the present invention.
Figure 6:
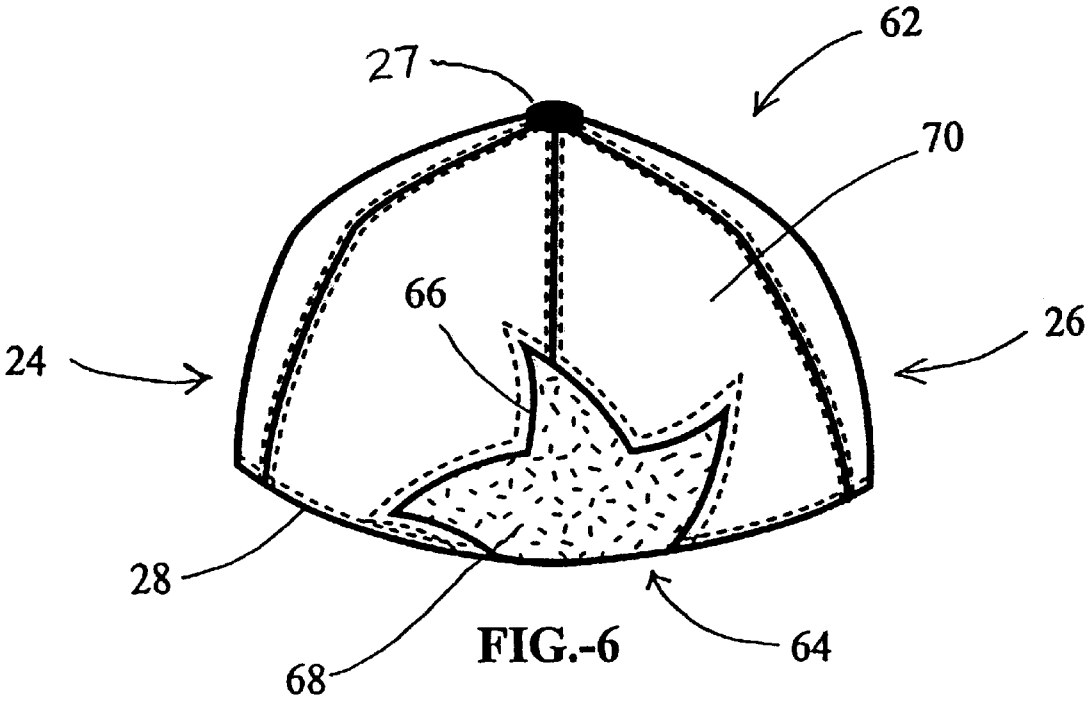
FIG. 6 is a rear elevational view of a fifth embodiment of an adjustable cap apparatus in accordance with the present invention.

Referring also to FIG. 3 through FIG. 6, it is contemplated that opening 16, and hence, adjustment band 18, may have various shapes. For example, in FIG. 3, a second embodiment of an adjustable cap apparatus 32 in accordance with the present invention is generally shown. Second embodiment of adjustable cap apparatus 32 comprises an opening 34 having a generally rectangular shape that is outlined by a border 36. An adjustment band 38 completely fills a void in the crown portion 40 created by opening 34. In FIG. 4, a third embodiment of an adjustable cap apparatus 42 in accordance with the present invention is generally shown. Third embodiment of an adjustable cap apparatus 42 comprises an opening 44 having a generally triangular shape that is outlined by a border 46. An adjustment band 48 completely fills a void in the crown portion 50 created by opening 44. In FIG. 5, a fourth embodiment of an adjustable cap apparatus 52 in accordance with the present invention is generally shown. Fourth embodiment of adjustable cap apparatus 52 comprises an opening 54 having a generally pentagonal shape that is outlined by a border 56. An adjustment band 58 completely fills the void in the crown portion 60 created by opening 54. In FIG. 6, a fifth embodiment of an adjustable cap apparatus 62 in accordance with the present invention is generally shown. Fifth embodiment of adjustable cap apparatus 62 comprises an opening 64 having a generally semi-star shape that is outlined by a border 66. An adjustment band 68 completely fills the void in the crown portion 70 created by opening 64.

An infinite variety of shapes not herein disclosed is contemplated by the inventor. Regardless of the shapes of openings 16, 34, 44, 54, and 64, however, it can be seen that each is disposed on rear end 22 of crown portions 12, 40, 50, 60, and 70 and partially separates left side 24 and right side 26 of crown portions 12, 40, 50, 60, and 70. It can further be seen that adjustment bands 18, 38, 48, 58, and 68 completely fill the void created by openings 16, 34, 44, 54, and 64, respectively, and extend from borders 30, 36, 46, 56, and 66, down to bottom edge 28 of crown portion 12, 40, 50, 60, and 70, respectively. Openings 34, 44, 54, and 64 extend upwardly from bottom edge 28 of crown portion 40, 50, 60, and 70, respectively, part way toward vertex 27.

Accordingly, it will be seen that this invention provides for an adjustable cap having an opening disposed on its rear end thereof, with a stretchable material completely covering the opening such that the wearer enjoys a comfortable fit, as well as an aesthetically pleasing appearance, without the aforementioned problems. Although the description above contains many specificities, these should not be construed as limiting the scope of the invention but as merely providing illustrations of some of the presently preferred embodiments of this invention. Thus, the scope of this invention should be determined by the appended claims and their legal equivalents.

What is claimed is:

1. An adjustable cap apparatus, comprising:

(a) a crown portion, said crown portion comprising predominantly of a first material, said crown portion including a bottom edge, a vertex, a front end and a rear end;

(b) a visor attached to said front end of said crown portion;

(c) an opening disposed on said rear end of said crown portion, said opening outlined by a border, wherein said opening extends upwardly from said bottom edge part way towards said vertex of said crown portion; and (d) a second material completely covering said opening in said rear end of said crown portion, wherein said second material having a greater stretchability than said first material.

2. An apparatus as recited in claim 1, wherein said crown portion includes a bottom edge, and wherein said border of said opening extends to said bottom edge of said crown portion.

3. An apparatus as recited in claim 1, wherein said first material is stretchable fabric.

4. An apparatus as recited in claim 1, wherein said first material is plastic.

5. An apparatus as recited in claim 1, wherein said first material is generally non-stretchable fabric.

6. An apparatus as recited in claim 1, further comprising a third material, said third material disposed on said front end of said crown portion.

7. An apparatus as recited in claim 1, wherein said second material is sewn to said crown portion adjacent said border of said opening.

8. An adjustable cap apparatus, comprising:

(a) a crown portion, said crown portion including a bottom edge, a vertex, a front end and a rear end;

(b) a visor attached to said front end of said crown portion;

(c) an opening disposed on said rear end of said crown portion, wherein said opening extends upwardly from said bottom edge part way towards said vertex of said crown portion; and (d) an elastic material completely covering said opening in said rear end of said crown portion.

9. An apparatus as recited in claim 8, wherein said crown portion includes a bottom edge, and wherein said opening in said rear end of said crown portion extends to said bottom edge of said crown portion.

10. An apparatus as recited in claim 8, wherein said crown portion is comprising predominantly of a stretchable fabric, wherein said elastic material covering said opening having a greater stretchability than said stretchable fabric.

11. An apparatus as recited in claim 8, wherein said elastic material is sewn to said crown portion adjacent a border of said opening.

12. An apparatus as recited in claim 8, wherein said first material is plastic.

13. An apparatus as recited in claim 8, wherein said first material is generally non-stretchable fabric.

14. An adjustable cap apparatus, comprising:

(a) a crown portion composed predominantly of a first material, said crown portion including a vertex, a front end, a rear end, a left side, a right side, and a bottom edge;

(b) a visor attached to said front end of said of said crown portion adjacent said bottom edge;

(c) an opening disposed on said rear end of said crown portion and outlined by a border, said opening extending from said bottom edge of said crown portion part way towards said vertex of said crown portion and partially separates said left side and said right side of said crown portion; and (d) a second stretchable material sewn to said rear end of said crown portion and completely covering said opening such that surface continuity between said crown portion and said stretchable material is maintained throughout the border of said opening;

(e) wherein said second material has a greater stretchability than said first material, thereby allowing for adjustability of said left side and said right side of said crown portion relative to each other.

15. An apparatus as recited in claim 14, wherein said first material is stretchable fabric.

16. An apparatus as recited in claim 14, wherein said first material is plastic.

17. An apparatus as recited in claim 14, wherein said first material is generally non-stretchable fabric.

18. An apparatus as recited in claim 14, wherein said second stretchable material is sewn to said crown portion adjacent a border of said opening.

19. An apparatus as recited in claim 14, further comprising a third material, said third material disposed on said front end of said crown portion.

* * * * *